US008225420B2

(12) United States Patent
Keillor

(10) Patent No.: US 8,225,420 B2
(45) Date of Patent: Jul. 24, 2012

(54) HELMET HEAT SHIELD

(76) Inventor: Howard R. Keillor, Fayetteville, GA (US)

( * ) Notice: Subject to any disclaimer, the term of this patent is extended or adjusted under 35 U.S.C. 154(b) by 86 days.

(21) Appl. No.: 12/590,405

(22) Filed: Nov. 6, 2009

(65) Prior Publication Data

US 2010/0186135 A1 Jul. 29, 2010

Related U.S. Application Data

(63) Continuation of application No. 11/879,663, filed on Jul. 19, 2007, now abandoned.

(51) Int. Cl.
*A42B 1/00* (2006.01)

(52) U.S. Cl. ..... 2/7

(58) Field of Classification Search ..... 2/5, 7, 8.1, 2/8.2, 410, 422, 424, 425
See application file for complete search history.

(56) References Cited

U.S. PATENT DOCUMENTS

| | | | | |
|---|---|---|---|---|
| 3,496,854 | A * | 2/1970 | Hill et al. | 454/370 |
| 3,748,657 | A * | 7/1973 | Aileo | 2/6.4 |
| 4,209,858 | A * | 7/1980 | Coenen | 2/412 |
| 4,223,409 | A | 9/1980 | Lee | |
| 4,653,123 | A * | 3/1987 | Broersma | 2/425 |
| 4,993,082 | A | 2/1991 | Gentes et al. | |
| 5,056,156 | A * | 10/1991 | Kosmo et al. | 2/411 |
| 5,093,937 | A | 3/1992 | Kamata | |
| 5,566,399 | A * | 10/1996 | Cartwright et al. | 2/421 |
| 6,247,186 | B1 * | 6/2001 | Huang | 2/410 |
| 6,321,386 | B1 * | 11/2001 | Monica | 2/7 |
| 6,857,135 | B2 * | 2/2005 | Sumitomo | 2/410 |
| 7,296,304 | B2 | 11/2007 | Goldsborough | |
| 2005/0177918 | A1 * | 8/2005 | Liu | 2/7 |
| 2005/0241049 | A1 * | 11/2005 | Ambuske et al. | 2/412 |

FOREIGN PATENT DOCUMENTS

| | | | |
|---|---|---|---|
| JP | 09228135 | A * | 9/1997 |
| JP | 2006249626 | A * | 9/2006 |
| JP | 2011256505 | A * | 12/2011 |

* cited by examiner

*Primary Examiner* — Khoa Huynh
*Assistant Examiner* — Anna Kinsaul
(74) *Attorney, Agent, or Firm* — J. T. Hollin, Attorney at Law, P.C.

(57) ABSTRACT

A helmet heat shield affixed over the top of a helmet of the type worn by riders of motorcycles, all-terrain vehicles, bicycles, and other similar open-air vehicles. The inner surface of the heat shield conforms to the contour and shape of the upper portion of the helmet and further, provides an air gap between the helmet and the heat shield. A radiant barrier attached to the inner surface of the heat shield assists in dissipating heat away from the helmet surface. The air gap also permits air to circulate through freely, thereby significantly reducing the heat transfer to the exterior surface and interior of the helmet. The heat shield may be manufactured as an integral part of the helmet.

3 Claims, 5 Drawing Sheets

HELMET HEAT SHIELD

CROSS-REFERENCES TO RELATED APPLICATIONS

This application claims the benefit of a previous provisional application, No. 60/854,630 filled Oct. 27, 2006. Further, this application is a continuation-in-part of application Ser. No. 11/879,663 filed on Jul. 19, 2007 and references the content of these applications as fully as though appearing herein.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION (1) Field of the Invention

The present invention relates generally to materials, methods, and devices which are designed to prevent heat build-up within the interior of a helmet. Various means of venting, such as the use of intake and exhaust holes are frequently used to help reduce the effects of heat accumulation. These features can be seen in military combat helmets, football helmets and safety helmets such as these are used for motorcycle riding, ATV riding and the like.

Protective helmets used by riders of motorcycles and similar open-air vehicles typically include vent holes for the purpose of air intake and exhaust to minimize heat buildup inside the helmet. These in general are somewhat effective, however, minimally so when the rider brings the motorcycle to a stop. Nonetheless a variety of intake and exhaust ports have been used in an attempt to prevent heat buildup.

Many kinds of helmets employ additional techniques to further attempt to prevent heat build-up within the helmet. These include scoops to help induce more air through the ports. Other venting methods are well known such as adding exhaust vents, relocating them, increasing their size and quantity, and adding air channels inside the helmet. Most helmets employ foam insulation and padding to the interior of helmets mainly for comfort and impact safety and also as an insulator.

There is clearly a need for a shield that can be easily integrated with helmets and which can reduce both the conductive and radiant heat transfer to the interior of the helmet and subsequently to its user.

(2) Description of the Related Art, Including Information Disclosed under 37 CFR 1.97 and 1.98

The inventor in U.S. Pat. No. 7,296,304 (Goldsborough, 2007) devised a helmet system comprising a blower fan, and a thermoelectric cooling element which are both installed inside the helmet. Air drawn in to the helmet passes over the thermoelectric cooling element and thereby air conditions the head receiving region of the helmet.

U.S. Pat. No. 5,093,937 (Kamata, 1992) discloses a helmet device for a vehicle rider, which device comprises a cap (helmet) body, a visor mounted on the upper front portion of the cap body, and a ventilating hole located on the upper front of the cap body. The visor features a shutter which may be positioned to allow or block airflow through the ventilating hole.

U.S. Pat. No. 4,993,082 (Gentes, 1991) presents several methods of manufacturing a helmet with an integral molded cover shell for the purpose of protecting and decorating the exterior surface of the helmet body. One embodiment of the invention includes at least one ventilating hole for the passage of air through the helmet body.

A helmet provided with interior shock-proof devices and exterior ventilative devices is featured in U.S. Pat. No. 4,223,409 (Lee, 1980). The exterior devices comprise a plurality of plastic strips attached slightly above the outer surface of the helmet so as to enhance the flow of air about the surface of the helmet.

BRIEF SUMMARY OF THE INVENTIVE CONCEPT

This device relates to a heat shield that provides a degree of protection from the effects of solar heat which is continuously absorbed by a helmet worn outdoors by the rider of an open-air vehicle. The heat shield comprises a layer of material substantially surrounding or covering the upper portions of the helmet. A means of attachment secures the heat shield to the helmet, and simultaneously allows an air gap separating the helmet and the inner surface of the heat shield. Another embodiment allows the heat shield to be removable or retractable by use of conventional means such as snaps, hinges, slides, or swivel joints. The heat shield effectively shades the helmet, blocking and reducing the transfer of radiant heat to the outer surface of the helmet and the subsequent transfer of conductive heat to the user. Other embodiments allow the heat shield to be permanently affixed to the helmet by means of glue or other conventional methods of bonding. Further, the heat shield is adaptable to being manufactured as an integral part of a helmet.

Preferably, the heat shield is formed of polycarbonate material, however various types of laminates, plastic, or blended metals are also feasible. The inventive concept may be further enhanced by the inclusion of a layer of reflective or radiant material to the interior surface of the heat shield.

Partial Index to Components Nomenclature

| | |
|---|---|
| 1. | Heat shield |
| 2. | Shell |
| 3. | Shell outer surface |
| 4. | Shell, inner surface |
| 5. | Post |
| 6. | Helmet insulation |
| 7. | Helmet wall |
| 8. | Radiant barrier |
| 9. | Helmet |
| 10. | Helmet outer surface |
| 11. | Helmet inner surface |
| 12. | Half-helmet |
| 13. | Full-face helmet |
| 14. | Three-quarter helmet |
| 15. | Screw |
| 16. | Passage hole |
| 17. | Screw receptor |
| 18. | Swivel joint |
| 19. | Air gap |
| 20. | Face shield |
| 21. | Pin |

DETAILED DESCRIPTION OF THE INVENTION

Figure 1:
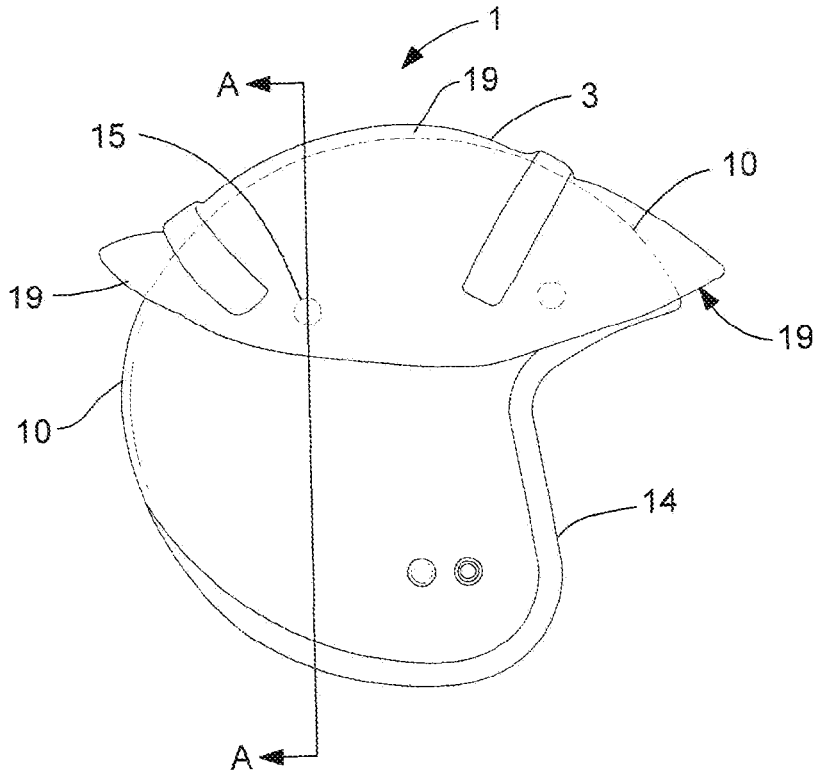
FIG. 1 is a side view of a heat shield positioned over the upper exterior surface of a typical helmet.

The embodiments shown, by way of the accompanying figures, depict the heat shield 1 according to the invention as it protects various styles and types of safety helmets worn by a rider. FIG. 1 presents a side view of a conventional three-quarter-helmet 14 and the preferred embodiment of the heat shield 1 as it fits over the top exterior surface 10 of the helmet 14. The spacing between the outer surface 10 of the helmet 14 and outer surface of the outer shell 3 of the heat shield 1 generally defines an air gap 19. The air gap 19 enhances air flow and a cooling effect for the wearer. The heat shield 1 preferably comprises a layer of polycarbonate, although other materials, such as polymers, fiberglass, metal, and plastic, are also useable for this inventive concept.

The heat shield 1 follows the contour of the helmet's 1 upper outer surface 10, thus allowing the air to circulate freely throughout the air gap 19. The heat shield 1 effectively shades the helmet 14, blocking and reducing the transfer of conductive and radiant heat to the helmet 14 and subsequently to the user's head. The heat shield 1 also functions effectively to provide the benefit of additional impact protection for the rider's head in the event of an accident.

Figure 2:
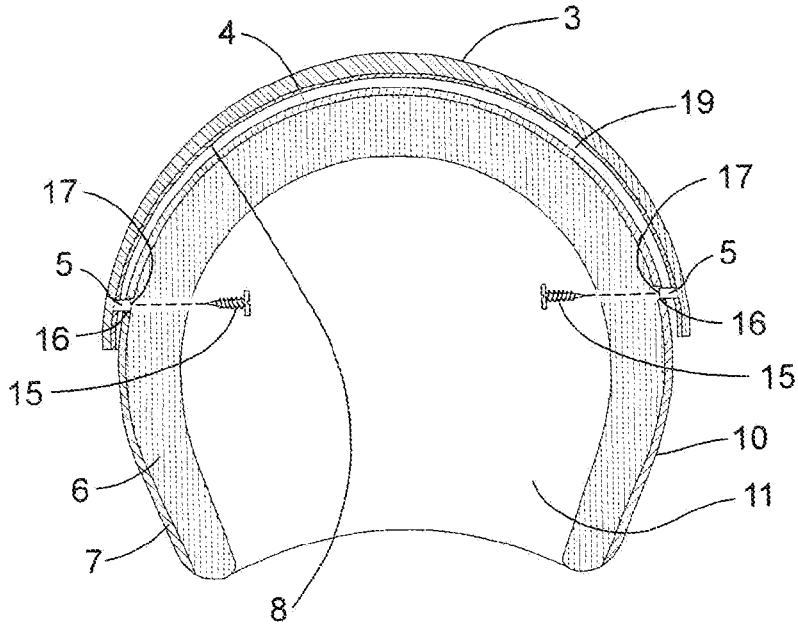
FIG. 2 is a vertical cross-sectional view taken along line A-A of FIG. 1.
Figure 5:
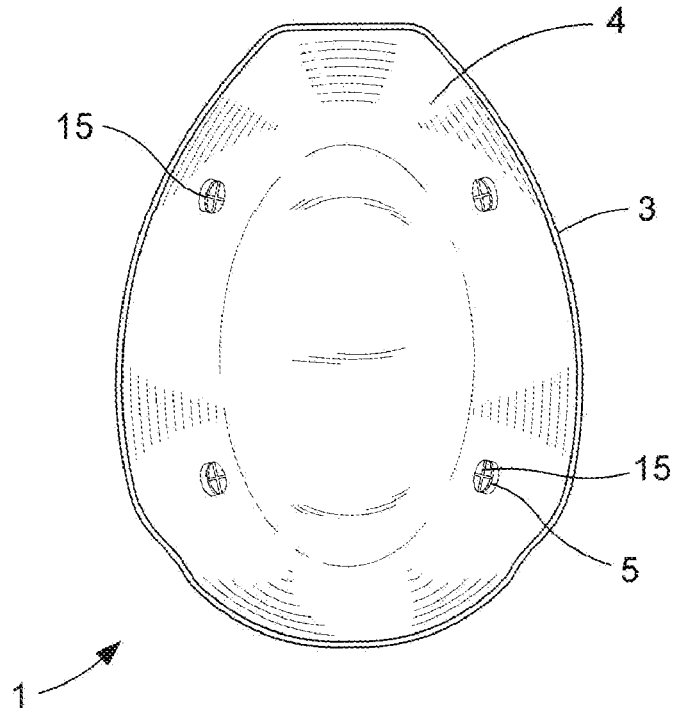
FIG. 5 is an interior view of the preferred embodiment of the heat shield, depicting posts and screws used as attaching means.

FIG. 2 presents an interior view, as oriented along the line B-B of FIG. 1, of the heat shield 1 in position over the outer surface 10 of a typical helmet. The helmet may be either a half-helmet 12, full-face helmet 13, of a three-quarter helmet 14. The heat shield is essentially a shell-type device with an outer surface 3 and an inner surface 4. A radiant barrier 8, being a thin layer of material with radiant reflective qualities, is adhesively fixed to the inner surface 4 of the heat shield 1. The embodiment in FIG. 2 shows tapered screws 15 positioned for insertion through the helmet insulation 6, and placement through a passage hole 16 in the helmet wall 7. Four posts 5, which are more clearly shown in FIG. 5, are an integral part of the inner surface 4 of the shell. Each post 5 accepts each screw 15 which is then fastened tightly into the innards of the post 5.

Figure 3:
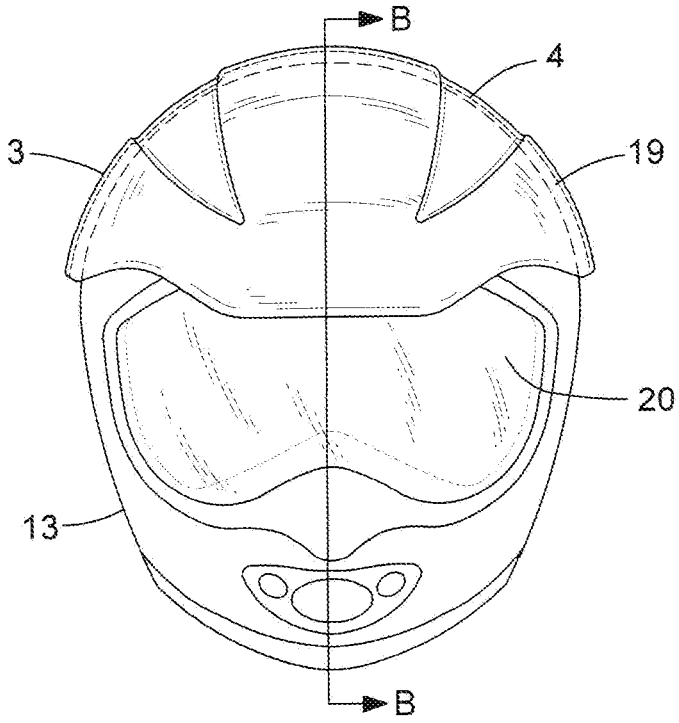
FIG. 3 is a front elevation view of an embodiment of the heat shield attached to a full-face helmet.

As further clarification of the functions of the inventive concept, FIG. 3 presents a front elevation of a full-face helmet 13, with broken lines indicating the air gap 19 and general outline of the outer surface 3 of the heat shield 1.

Figure 4:
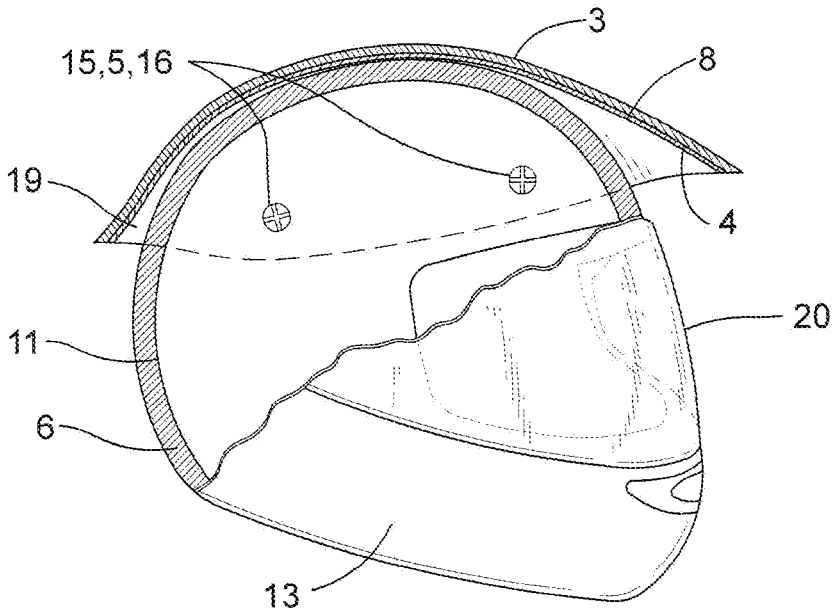
FIG. 4 is a side cross-sectional view as seen from a cutout at line B-B of FIG. 3.

FIG. 4 depicts a cross-sectional view of the heat shield 1 as fitted over the upper outer surface of a full-face helmet 13. The view is as seen from a section excised along the line B-B in FIG. 3. The embodiment shown in FIG. 4 utilizes slotted screws 15 to accomplish the fastening of the heat shield 1 to the helmet 13. The screws 15 may be machine screws, sheet metal screws, lag screws, or other suitable type of screw. In this embodiment, insertion of each screw 15 is begun in the interior of the helmet 13, through a passage hole 16 in the helmet and afterwards, fastened securely into each post 5 on the inner surface of the heat shield shell 4. Also shown is the air gap 19 formed between the inner surface 4 of the heat shield and the outer surface of the helmet 13.

In viewing FIG. 5, the placement and orientation of the heat shield posts 5 and the attaching screws 15 are shown from the underside, or inner surface 4 of the heat shield 1.

Figure 6:
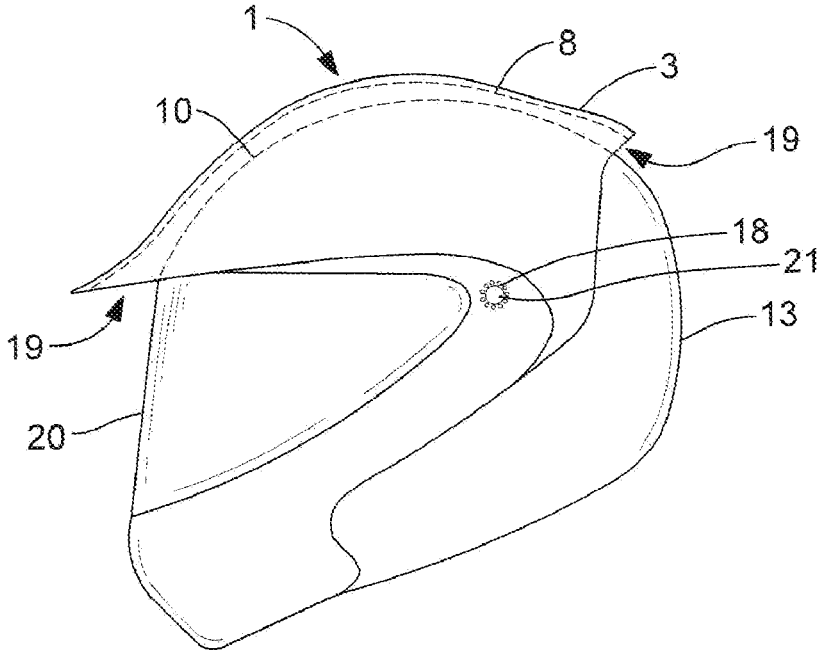
FIG. 6 is a perspective view of an embodiment of a helmet having an integral, hinged heat shield.
Figure 7:
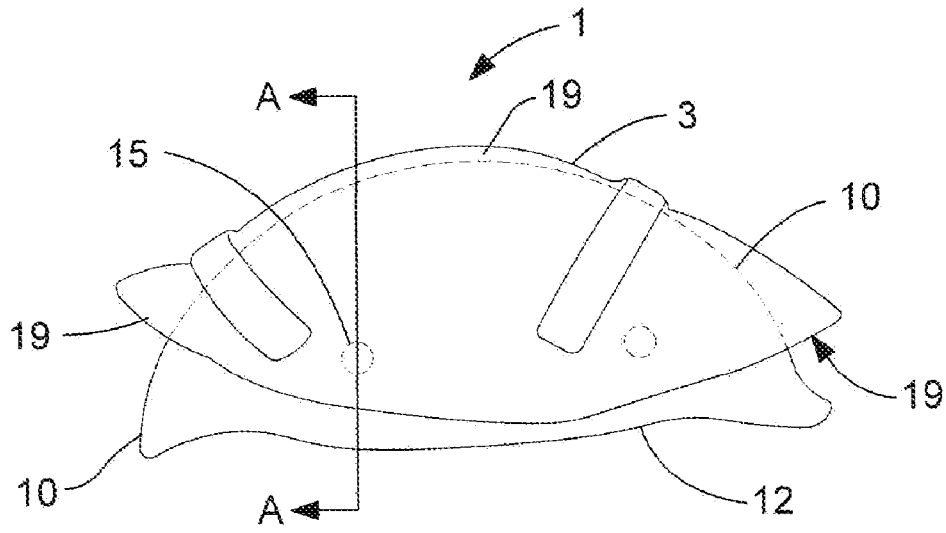
FIG. 7 is a side view of the heat shield mounted on a half-helmet.
Figure 8:
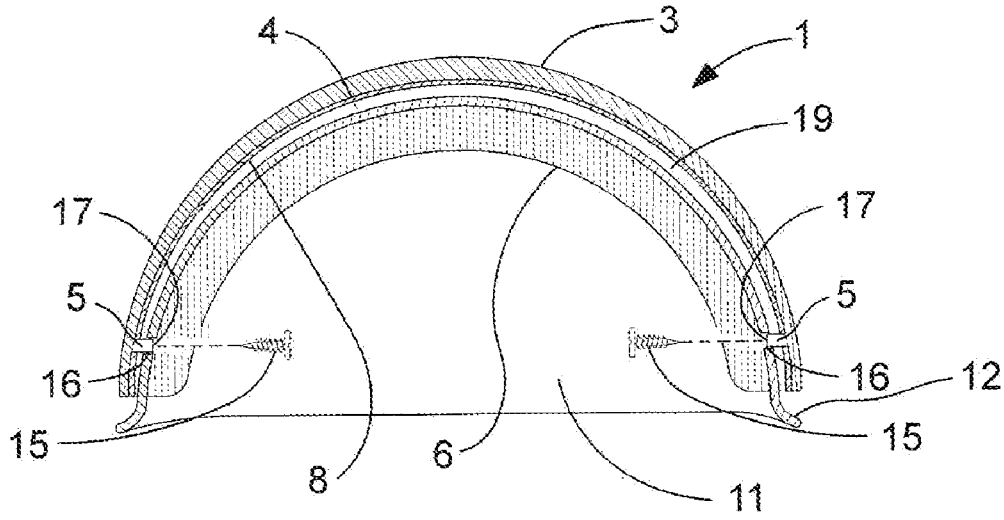
FIG. 8 is a cross-sectional view of the heat shield mounted on a half-helmet,as seen from the section line A-A of FIG. 7.
Figure 9:
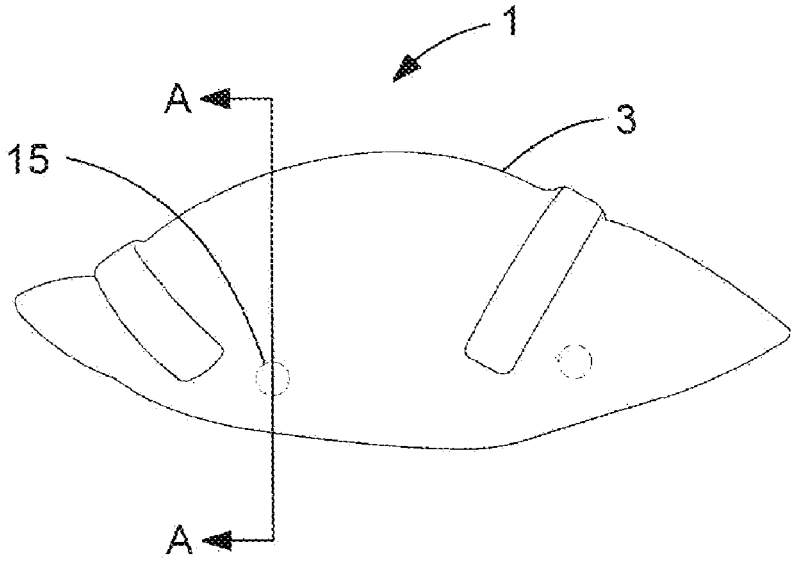
FIG. 9 is a side view of a stand-alone heat shield.
Figure 10:
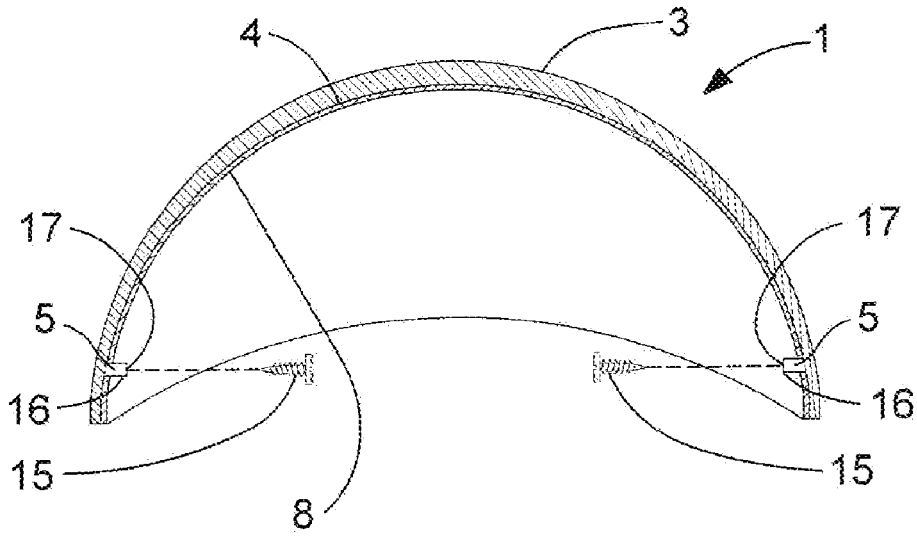
FIG. 10 is a cross-sectional view of the stand-alone heat shield as seen from section line A-A of FIG. 9.

FIG. 6 presents an embodiment of a full-face helmet 13 with a hinged heat shield 1 attached. This embodiment of the heat shield 1 is attached to the helmet 13 by means of a swivel joint 18 comprised of a pin 21 which extends from the outer surface 3 of the heat shield 1 to the inner surface 10 of the helmet 13, and is fastened in place by a suitable means. The swivel joint 18 serves as a horizontally-oriented pivot axis for the heat shield 1, which may be retracted rearward, or repositioned for a different coverage over the exterior surface of the helmet 13.

While preferred embodiments of the present inventive concept have been shown and disclosed herein, it must be realized that such embodiments are presented by way of example only, and not as a limitation of the scope of the inventive concept. Numerous variations, changes, and substitutions may occur or be suggested to those skilled in the art without departing from the intent, scope, and totality of the inventive concept. Such variations, changes, and substitutions may involve other features which are already known per se and which may be used instead of, or in addition to features already disclosed herein.

The invention claimed is:

1. A heat shield assembly contoured to fit over an exterior surface of a helmet of the type worn by riders of motorcycles, all-terrain vehicles, bicycles, and other similar open-air vehicles, the heat shield comprising a hemispherical-shaped shell having an outer surface and an inner surface;

a hemispherical-shaped, thin radiant barrier adhesively attached to the inner surface of said shell;

a plurality of posts attached to the inner surface of said shell; and a means of fastening said hemispherical-shaped shell to the helmet, wherein said shell is constructed and molded so as to substantially surround the exterior surface of the an upper portion of said helmet, the upper portion of the helmet extending from a helmet's left ear area to a helmet's right ear area and further extending in a transverse direction from a helmet's forehead area to a rearward position in a helmet's occipital area by operation of said fastening means, said fastening means further operated so as to leave a continuous air gap between said radiant barrier and the exterior surface of said helmet to provide enhanced air flow.

2. A heat shield assembly as in claim 1, wherein said heat shield assembly is attachable to a helmet of a type selected from the group consisting of a half-helmet, a three-quarter helmet, and a full-face helmet.

3. A heat shield assembly as in claim 1, wherein said means for fastening comprises screws selected from the group consisting of machine screws, sheet metal screws, and lag screws, said screws being inserted through passage holes from an interior surface of said helmet, said passage holes being located at points co-located with said posts and thereupon, said screws being fastened securely into said posts.

* * * * *